United States Patent [19]

Cook

[11] Patent Number: 4,469,079

[45] Date of Patent: Sep. 4, 1984

[54] EXHAUST GAS RECIRCULATION (EGR) SYSTEM

[75] Inventor: John E. Cook, Chatham, Canada

[73] Assignee: Canadian Fram Limited, Canada

[21] Appl. No.: 431,979

[22] Filed: Sep. 30, 1982

[51] Int. Cl.[3] ..... F02M 25/06

[52] U.S. Cl. ..... 123/571

[58] Field of Search ..... 123/571

[56] References Cited

U.S. PATENT DOCUMENTS 4,274,385 6/1981 Yuzawa et al. ..... 123/571

*Primary Examiner*—Wendell E. Burns

*Attorney, Agent, or Firm*—Markell Seitzman; Russel c. Wells

[57] ABSTRACT

This invention relates to electronically controlled exhaust gas recirculation valves and more particularly to systems incorporating an electrical vacuum regulator.

It is therefore an object of the present invention to provide an EGR system that is less susceptible to output flow changes caused by carbon build up. A further object of the invention is to provide a vacuum regulator that can be used with simple, low cost EGR valves. Simple valves can be used by virtue of the closed loop vacuum regulation feature of the present invention since the flow rate/vacuum signal relationship is not important. A further object of the present invention is to provide an EGR flow regulation system which automatically compensates for pressure variations which result in changes in the pressure differential across the EGR valve due to changes in exhaust system pressure and intake manifold pressure.

Many other objects and purposes of the invention will be clear from the following detailed description of the drawing.

7 Claims, 2 Drawing Figures

EXHAUST GAS RECIRCULATION (EGR) SYSTEM

DETAILED DESCRIPTION OF THE DRAWING

DETAILED DESCRIPTION OF THE DRAWING

Figures 1, 2:
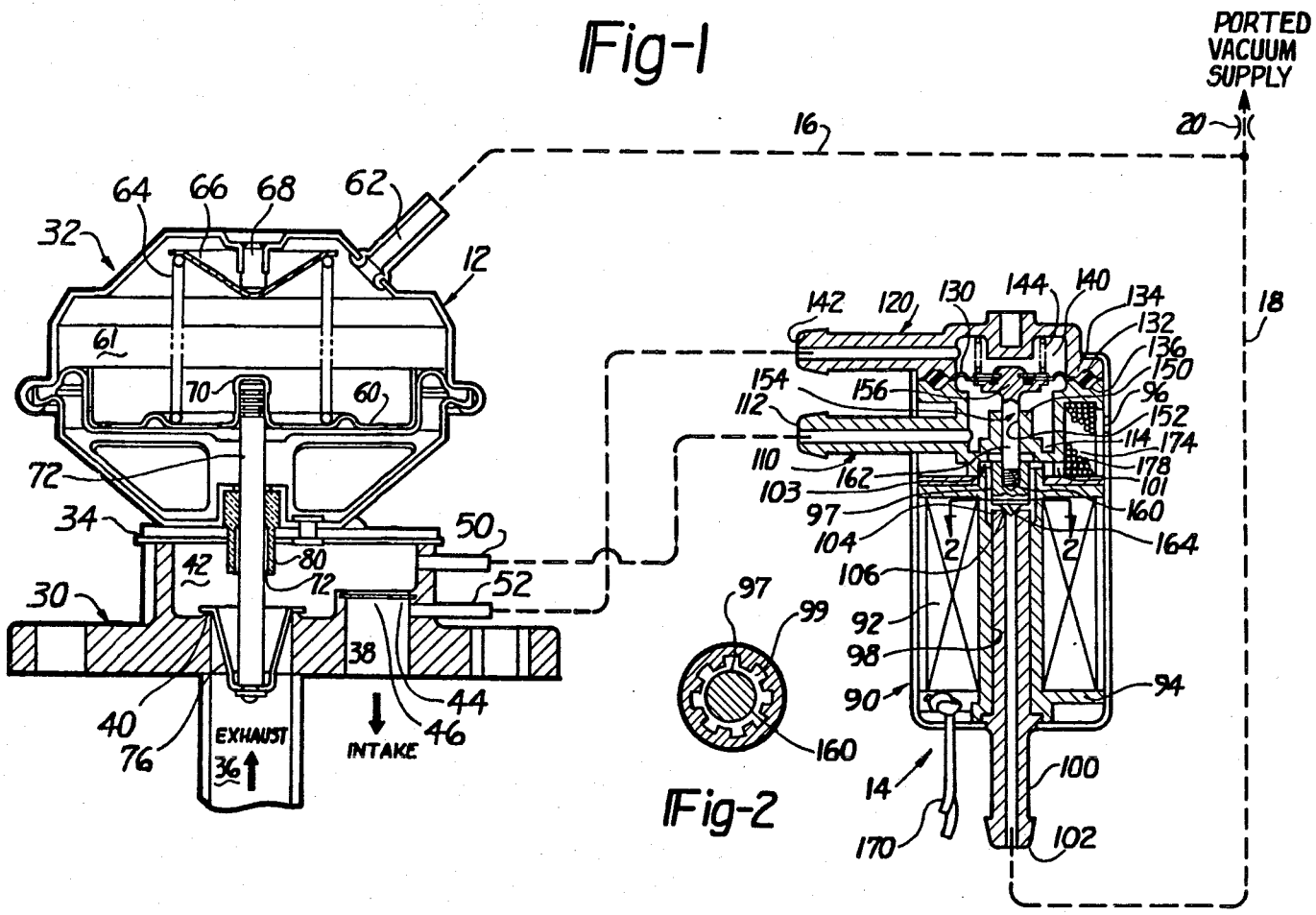
FIG. 1 represents a sectional view illustrating an EGR valve and an electrical vacuum regulator (EVR).
FIG. 2 is a partial sectional view taken through section 2—2 of FIG. 1.

With reference to FIG. 1, there is shown in EGR system comprising an EGR valve 12 and an electrical vacuum regulator (EVR) 14. The EGR 12 and the regulator 14 communicate via vacuum tubes 16 and 18, respectively to a vacuum supply. The vacuum supply can be manifold pressure or a ported vacuum source which is characterized as having a zero vacuum level at idle and a vacuum level that approaches manifold vacuum as the engine throttle opens. The vacuum tubes 16 and 18 are connected to one another and to the vacuum supply via an orifice 20. The EGR valve 12 comprises a lower housing 30 and an upper housing 32. A mounting plate 34 is used to mount the upper housing 32 to the lower housing 30. The lower housing further includes an intake port 36 adapted to receive flow from the exhaust system of the engine and an exhaust port 38 adapted to communicate the exhaust gas to the intake manifold. The lower housing 30 defines a valve seat 40. The lower housing 30 and mounting plate 34 cooperate to define a controlled pressure cavity 42. An orifice plate 44 is fitted within the housing interposing the controlled pressure cavity 42 and the port 38. The orifice plate 44 defines an orifice 46. The housing further includes an exhaust tube 50 for communicating a pressure signal indicative of the controlled pressure within the controlled pressure cavity 44 and further includes a manifold tube 52 for communicating a pressure signal indicative of the pressure downstream of the orifice plate 44. The EGR valve 12 further includes a diaphragm 60 mounted to the walls of the upper housing 32 and defining a vacuum chamber 61 therebetween. The other side of the diaphragm 60 is exposed to the atmosphere. A vacuum port 62 communicates the pressure input thereto to the vacuum chamber 61. A bias spring 64, spring plate 66 and adjusting screw 68 bias the spring 64 into engagement with the diaphragm 60. The diaphragm 60 includes a piston 70 adapted to receive a pin 72. The pin 72 extends from the upper housing 32 and through an opening 74 within the mounting plate. The other end of the piston is adapted to receive a valve element 76 which is adapted to seat upon the valve seat 40 to selectively control communication from the exhaust system to the controlled pressure chamber 42. More particularly, the pin 72 is mounted relative to the opening 74 by a bushing and seal member 80.

The vacuum regulator 14 comprises a housing 90. A coil 92, wound about a bobbin 94, is received within the housing. The housing further defines an opening or vent port 96 communicated to atmosphere or to a pressure level above that of the vacuum supply. The bobbin 94 defines a central, axial cylindrical bore 98 through which a vent tube 100 projects. The upper ends of bore 98 terminates in an enlarged portion 97. The walls of the bobbin 94 surrounding the enlarged portion 97 define a plurality of passages 99 as shown in FIG. 3. The vent tube 100 has a first end 102 extending from the housing 90 and adapted to communicate with the vacuum supply and the vacuum port 62 through vacuum tube 18. The other end 104 of the vent tube 100 defines a seat 106. The regulator 14 further includes a medial member 110 defining a first input port 112. The first input port terminates at a first chamber 114. The medial portion cooperates with the bobbin 94 to extend the enlarged portion 97 and plurality of passages 99 upwardly. The regulator 14 further includes passage means (101, 103) for communicating the vent port 96 to the enlarged portion 97 of the bore 98 and to end 104 of the vent tube. An upper member 120 is fitted to the housing 90. A flexible diaphragm 130 is mounted between the upper and medial members 110 and 120, respectively. More specifically, the diaphragm includes a peripheral annular portion 132 that is received within grooves 134 and 136 in the upper end medial members 120 and 110, respectively. The diaphragm separates the above noted first chamber 114 from a second chamber 140. The upper member 120 further includes a second port 142 communicating with the second chamber 140. A bias spring 144 interposing the upper member 120 and the diaphragm 130 applies a downward biasing force, as viewed in the figure, upon the diaphragm 130. Alternatively, the biasing spring 144 can be positioned in the first chamber 114 to apply a upwardly directed biasing force on the diaphragm. The medial portion 110 further includes a boss 150 defining a bore 152 positioned in axial relation relative to the valve seat 106. A pin 154 having one end 156 mounted to and movable with the diaphragm 130. The pin 154 further includes a nut 160 attached to a threaded stem 162. A closure element 164 is carried by the nut 160 for seating upon the valve seat 106. The pin 154 is reciprocally received within the bore 152 which acts as a guide member such that when in a downward position the closure element 160 will seat upon the valve seat 106. The pin 154 is preferably fabricated of a magnetic material and as such defines an armature which is attracted toward the valve seat in response to the magnetic field generated upon activation of coil 92 through the input wires 170. The medial portion 112 further defines a filter chamber 174 communicated to the opening 96. The filter chamber contains filter material 178 of a known variety. As previously mentioned, the passages 101 and 103 communicate the filter chamber 174 to the valve seat 106.

The EGR valve 12 and regulator 14 are shown in FIG. 1 in a no flow EGR condition, that is, with the valve element 76 seated upon its seat 40. This sealing action prohibits the flow of exhaust gas into the intake manifold. In operation it is desirable to control the relative proportion of the exhaust gas to fresh air ingested through the intake manifold. This is accomplished in the present invention by regulating the degree of vacuum communicated to the vacuum port 62 of the EGR valve 12. As will be seen from the discussion below the movement of the pin 154, within the regulator 14, away from its seat 106 is in proportion to the pressure differential P, between the first and second chambers 114 and 140 respctively, the bias force imparted by spring 140 on the diaphragm and the magnetic force of attraction exerted on the magnetic pin 154. In operation an engine electronic control unit of a known variety supplies an electrical signal to the coil 94 that is proportional to the desired EGR flow. The magnetic force of attraction on the pin 154 in combination with the bias force resulting from spring 144 maintains the closure element 164 in sealing engagement against the seat 106. In this condition atmospheric pressure is prohibited from being communicated from the vent tube 100 to the vacuum port 62. Consequently, the pressure condition within chamber 61 is defined by the characteristic of the vacuum supply and orifice. As previously mentioned the vacuum supply may be a ported vacuum supply often used in automotive systems. This type of vacuum supply generates a zero vacuum at idle and supplies full manifold vacuum after the throttle plate has moved a small degree. During idle conditions the spring 144 biases the pin 154 in a direction to seal off communication of atmosphere through vent tube 100. In addition, the ported vacuum supply supplies zero vacuum i.e., atmosphere to the vacuum port 62, consequently, with atmospheric pressure applied to the vacuum chamber 62, the valve element 62 remains at its valve seat 40 thus further prohibiting the flow. As the throttle is moved the degree of vacuum supplied to the vacuum port 62 increases. With this increase in pressure the diaphragm 60 in the EGR 12 is moved upwardly thus unseating the valve element 76 from its seat and permitting exhaust gases to flow through the orifice 76 and into the intake manifold. As soon as there is EGR flow a differental pressure is developed across the orifice 46. This differental pressure is communicated via ports 50 and 52 to corresponding ports 112 and 142 in the regulator 14. As the throttle is opened the EGR flow will increase as will the corresponding pressure differential communicated across the diaphragm 130. In order to limit the EGR flow to the required amount the pin 154 must be forced from its seat 102 thereby communicating atmospheric pressure via vent tube 100 to the EGR valve 12. This occurs when the pressure differential generated by the EGR flow is slightly greater than the closing force on the pin 154 which results from the combination of the magnetic force of attraction and the spring bias force. Once the pressure differential exceeds the closing force, atmospheric pressure is communicated to the EGR valve 12 thus reducing the pressure within the vacuum chamber 62 and thus permitting the valve element 76 to close against the seat 40. In this manner the EGR flow is about a nominal or desired, though variable, flow established by the magnetic force exerted on the pin 154. The EGR flow can be varied by changing the exciting current supplied to the coil 94.

Many changes and modifications in the above embodiment of the invention can of course be carried out without departing from the scope thereof. Accordingly that scope is intended to be limited only by the scope of the appended claims.

What is claimed is:

1. In combination a vacuum actuated EGR pressure regulation system (10) comprising:

an EGR valve (12) adapted to control the EGR flow between the exhaust system and the intake manifold of an engine, the EGR valve (12) defining a controlled pressure chamber (42) between the exhaust system and intake manifold and pressure means for generating and for communicating a pressure difference signal indicative of the EGR flow rate, said pressure means including a first port (50) communicated to the controlled pressure chamber (42) and a second port (52) located downstream of said controlled pressure chamber communicated to said intake manifold, said first port and said second port generating a pressure difference signal indicative of the EGR flow;

electric vacuum regulator means (14) comprising: a housing (90) defining an atmospheric vent (92);

a coil (92) mounted in said housing and responsive to control signals, for generating a magnetic field in proportion to a desired EGR flow;

vent means (100, 102, 104, 106) for defining a valve seat (106) in communication with the controlled pressure chamber and a vacuum supply;

passage means (97, 99, 101, 103) for communicating said atmospheric vent (92) to said valve seat (106);

diaphragm means (130) supported within said hosing defining first and second chambers (114, 140) sealed relative to one another and movable in response to the force differential thereacross;

first means (110) for communicating the intake manifold pressure signal to one of said chambers;

second means (120) for communicating the controlled pressure signal to the other of said chambers;

pin means (154) attached to and movable with said diaphragm means (130) and mounted for engagement with said valve seat (106), said pin means responsive to the magnetic field generated upon energization of said coil (94);

bias means (144) interposing said housing (90) and said diaphragm (130) for biasing said diaphragm relative to said valve seat (106).

2. A system as defined in claim 1 wherein said EGR valve includes an orifice separating said controlled pressure chamber from said intake manifold and located between said first pot and said second port.

3. The system as defined in claim 2 wherein said vent tube means (100) is received within said housing (90) having a bore (102) therethrough, the bore terminating at a first end (102) external to said housing and at a second end (104), for defining a valve seat (106), said first end (102) communicated to the controlled pressure chamber (42) of said EGR and with a vacuum supply and wherein said passage means communicate said second end (104) to said atmospheric vent (92).

4. The system as defined in claims 1 or 3 wherein:

when said pin means (154) is seated upon said valve seat (106) full vacuum, as established by a vacuum source, is communicated to the EGR valve (12) and said pin means (154) is urged relative to said valve seat (106) in response to the pressure differential across said diaphragm (130) to communicate atmospheric pressure to said EGR valve (12) during instances when the EGR flow increases from the desired flow.

5. The system as defined in claim 4 wherein:

said vacuum source is a ported vacuum source.

6. A flow regulator (14) for use within an EGR system having an EGR valve (12) of the type which generates a pressure differential signal in response to EGR flow therethrough, the flow regulator (14) comprising:

a diaphragm (130) movable in response to the pressure differential signal;

housing means (90, 110, 120) for defining a cavity (114, 140) for supporting said diaphragm, said diaphragm dividing said cavity into a lower or first chamber (114) and an upper or second chamber (140), means for receiving the pressure differential signal including first port means (110,112) for communicating a first pressure to said first chamber (114) and second port means (120, 142) for communicating a second pressure signal to said second chamber (140), said housing means further including vent port means (96, 174) for communicating atmospheric pressure thereto;

vent tube means received within said housing and adapted to communicate said vent port means to the EGR valve, including a vent tube (100) having a central bore, terminating in one end (102) external to said housing and at another end (104) internal thereto, said another end (104) terminating at a valve seat (106);

passage means (97, 99, 101, 103) for communicating said vent port means with said another end (104);

coil means responsive to control signals for developing a magnetic field proportional to the desired EGR flow;

armature means (154, 160, 162, 164) movable with said diaphragm (130) in response to the pressure differential thereacross and to the magnetic field for seating upon said valve seat;

bias means (144) fitted within said either first chamber (114) or second chamber (140) for biasing said pin means relative to said valve seat.

7. The flow regulator as defined in claim 6 wherein said bias means (144) is lodged in said second chamber (140) for biasing said diaphragm towards said valve seat (106).

* * * * *